United States Patent [19]

Pessina et al.

[11] Patent Number: 4,768,770

[45] Date of Patent: Sep. 6, 1988

[54] SIGNATURE FEEDER FOR A BOOKBINDING MACHINE

[76] Inventors: Giorgio Pessina; Aldo Perobelli, both of Via Timavo, 32 - Paderno Dugnano (Milano), Italy

[21] Appl. No.: 44,044

[22] Filed: Apr. 29, 1987

[30] Foreign Application Priority Data

May 2, 1986 [IT] Italy ..... 20287 A/86

[51] Int. Cl.[4] ..... B65H 3/08

[52] U.S. Cl. ..... 271/107; 271/31.1; 271/245; 271/243; 271/202; 271/150; 270/58

[58] Field of Search ..... 270/52, 54, 55, 56, 270/57, 58; 271/107, 31.1, 245, 243, 202, 150

[56] References Cited

U.S. PATENT DOCUMENTS

| | | | |
|---|---|---|---|
| 4,253,651 | 3/1981 | McInerny et al. | 270/58 |
| 4,402,497 | 9/1983 | Weibel et al. | 271/243 |
| 4,564,186 | 1/1986 | Clark, Jr. et al. | 270/54 |
| 4,718,565 | 1/1988 | Reist | 271/202 |

*Primary Examiner*—Robert E. Garrett
*Assistant Examiner*—Therese Newholm
*Attorney, Agent, or Firm*—Bucknam and Archer

[57] ABSTRACT

A signature feeder comprises an in-feed table for conveying signatures disposed in a stack adjacent one another and each in an almost vertical aspect to a signature separator operating to separate the signatures one at a time from the stack and transfer them to a signature elevator operating to raise them to an upper horizontal conveyor on which they are disposed in a partly overlapping shingle configuration. The signature separator comprises a plurality of sucker devices mounted on arms turnable about a horizontal spindle and a plurality of rotatable discs each having a circumferential recess or notch able to receive the lower edge of a signature removed from the stack by the sucker devices whereby to transfer it to the said signature elevator to be conveyed to an upper level and placed on the said upper horizontal conveyor which is constituted by conveyor belts driven at a slower speed than that of the said signature elevator and having cooperating rollers which cause the signatures to accumulate on the said upper horizontal conveyor in a partly overlapping configuration.

11 Claims, 4 Drawing Sheets

SIGNATURE FEEDER FOR A BOOKBINDING MACHINE

BACKGROUND OF THE INVENTION

In bookbinding installations considerable operating difficulties are usually encountered in the correct conveyance of the signatures to subsequent machines provided for further treatment or for the binding of the signatures themselves. Although apparatus for transferring the various signatures from one operating machine to another is known, these operate by taking them from stacks in which the signatures themselves are closely adjacent, in an almost vertical aspect, and disposing them in a horizontal partially accumulated orientation, and such apparatus is structurally rather complex and not completely reliable because of the necessity of taking each individual signature one at a time from the stack of signatures. This conventional apparatus, moreover, does not permit the relative distance of the mutually overlapped signatures conveyed on the horizontal output conveyor thereof to be correctly regulated to supply binding machines in dependence on the operating requirements of the machines themselves.

OBJECTS OF THE INVENTION

A primary object of the present invention is that of eliminating the disadvantages and limitations indicated above by providing a signature feeder which is structurally simple and of great reliability.

Another object of the present invention is that of providing a signature feeder machine which is able to guarantee the removal of a signle signature at a time from a stack of adjacent signatures.

Still another object of the present invention is that of providing a signature feeder machine which makes it possible to operate correctly on signatures of any different form.

SUMMARY OF THE INVENTION

According to the present invention a signature feeder comprises an in-feed table for conveying signatures disposed in a stack adjacent one another and each in an almost vertical aspect to a signature separator operating to separate the signatures one at a time from the stack and transfer them to a signature elevator operating to raise them to an upper horizontal conveyor on which they are disposed in a partly overlapping shingle configuration, the signature separator comprising a plurality of sucker devices mounted on arms turnable about a horizontal spindle and a plurality of rotatable discs each having a circumferential recess or notch able to receive the lower edge of a signature removed from the stack by the sucker devices whereby to transfer it to the said signature elevator to be conveyed to an upper level and placed on the said upper horizontal conveyor, which latter is constituted by conveyor belts running at a slower speed than that of the said signature elevator and having cooperating rollers which cause the signatures to accumulate on the said upper horizontal conveyor in a partly overlapping configuration.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Referring now to the attached drawings, the signature feeding machine of the invention comprises an in-feed table, generally indicated 1 which, as can be seen is slightly inclined in the direction of advance of the stacks of signatures 2.

Figure 3:
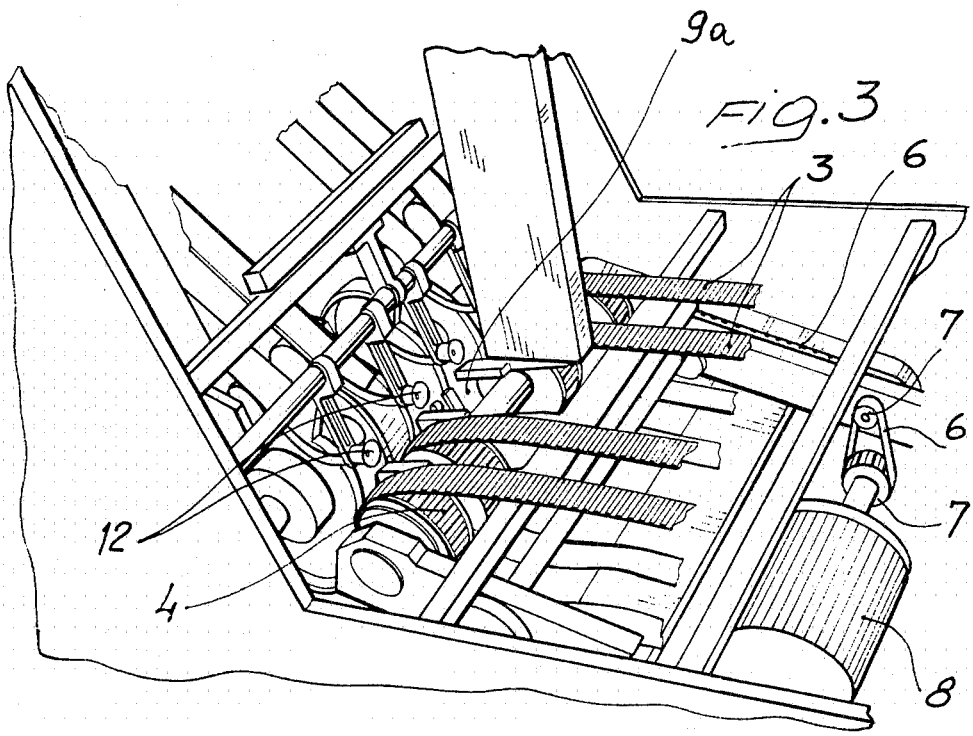
FIGS. 3 and 4 are perspective views of the in-feed table of the machine for the stack of signatures.
Figure 4:
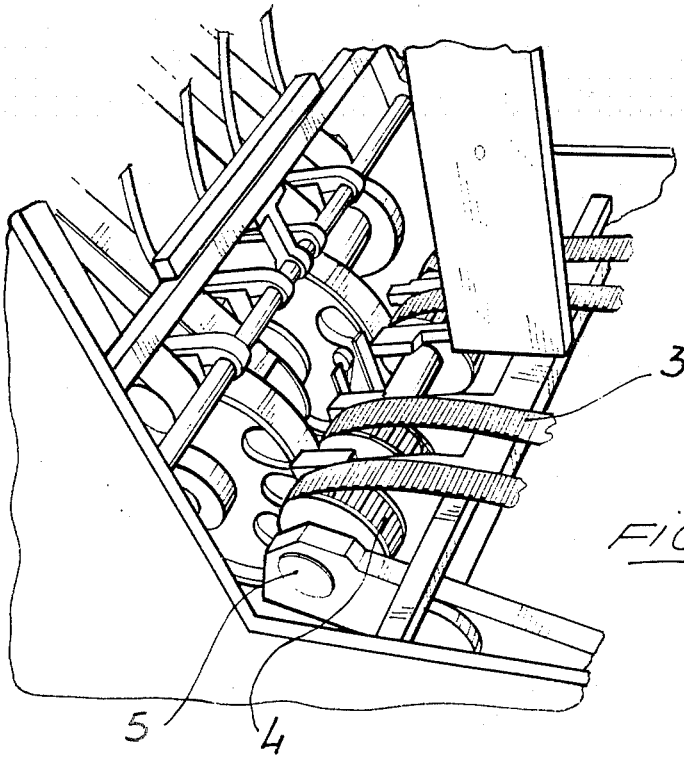
Figure 5:
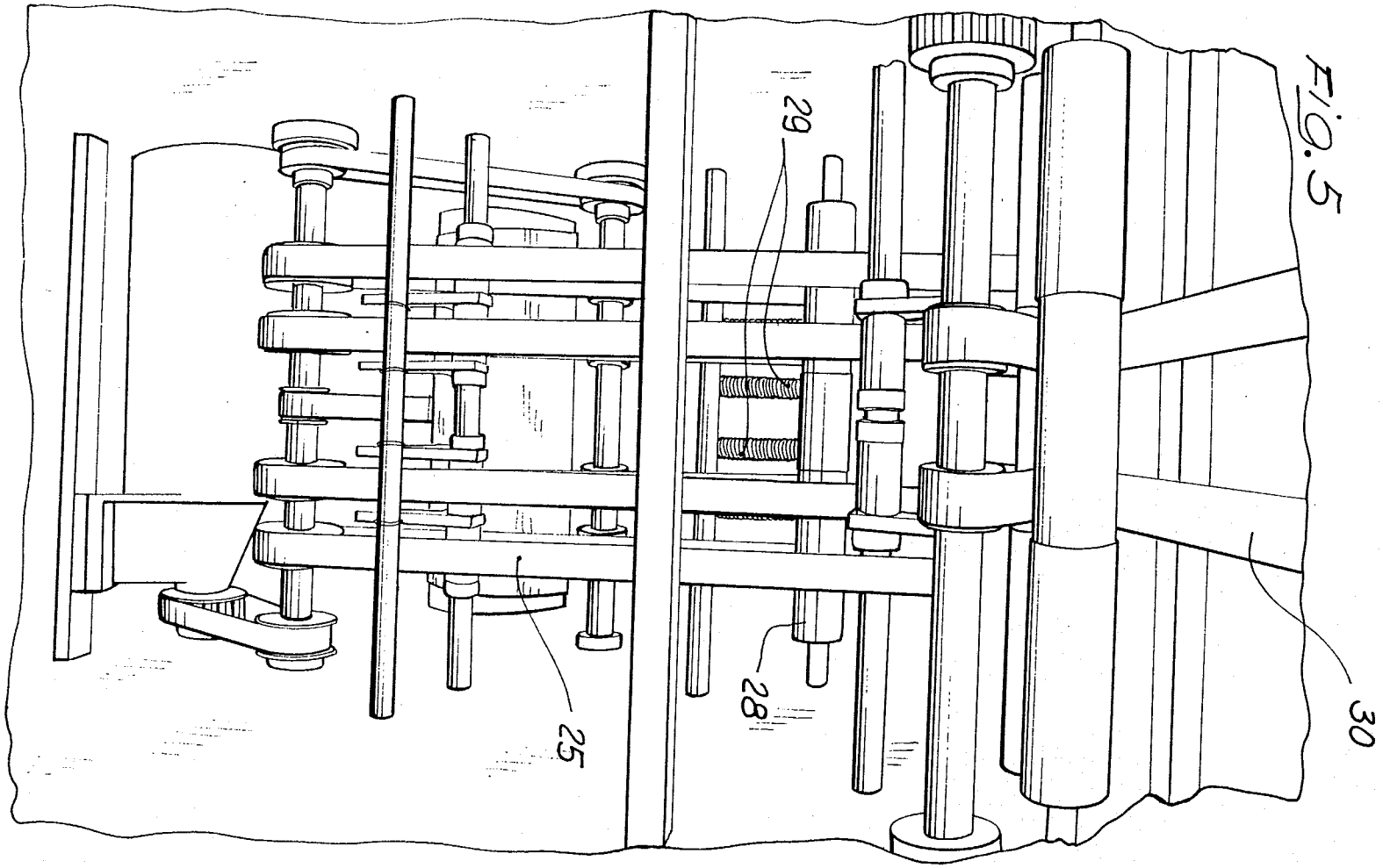
FIG. 5 is an interior view, seen from the output end of the machine, showing the elevator portion and a part of the horizontal final portion of the machine.
Figure 6:
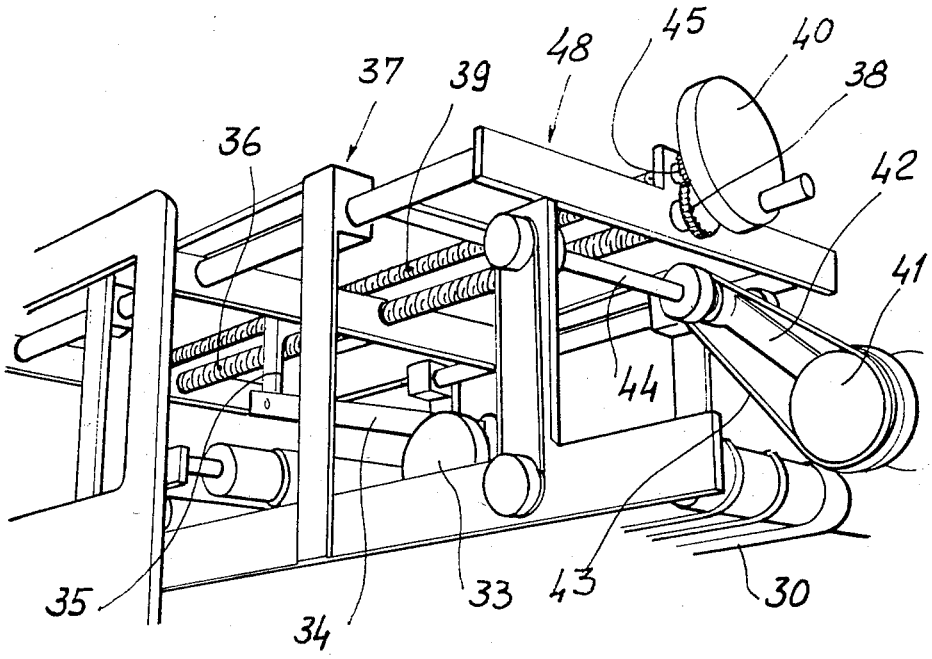
FIG. 6 is a perspective side view of the said horizontal portion of the machine.
Figure 7:
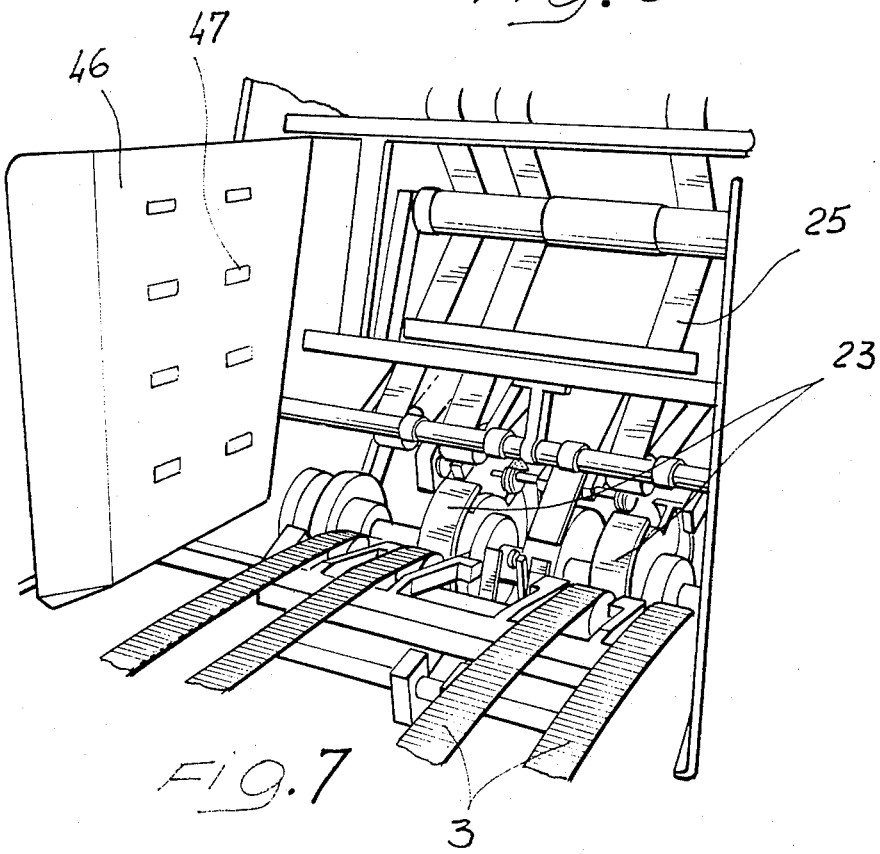
FIG. 7 is another perspective view of the said in-feed table.

This in-feed table is constituted by a plate (not shown) over which run a series of toothed belts 3 having a high co-efficient of friction. These belts 3 pass over respective pairs of pulleys of which, as can be seen in FIGS. 3 and 4 those at the downstream end are mounted on a transverse shaft 5 itself driven via belts 6 and pulleys 7 from a geared motor unit 8.

Downstream of the said in-feed table there is provided a device for separating individual signatures from the pack thereof, constituted by an abutment **9*a* formed at the end of an arm 9 mounted at the opposite end on a pivot 10**.

Figure 2:
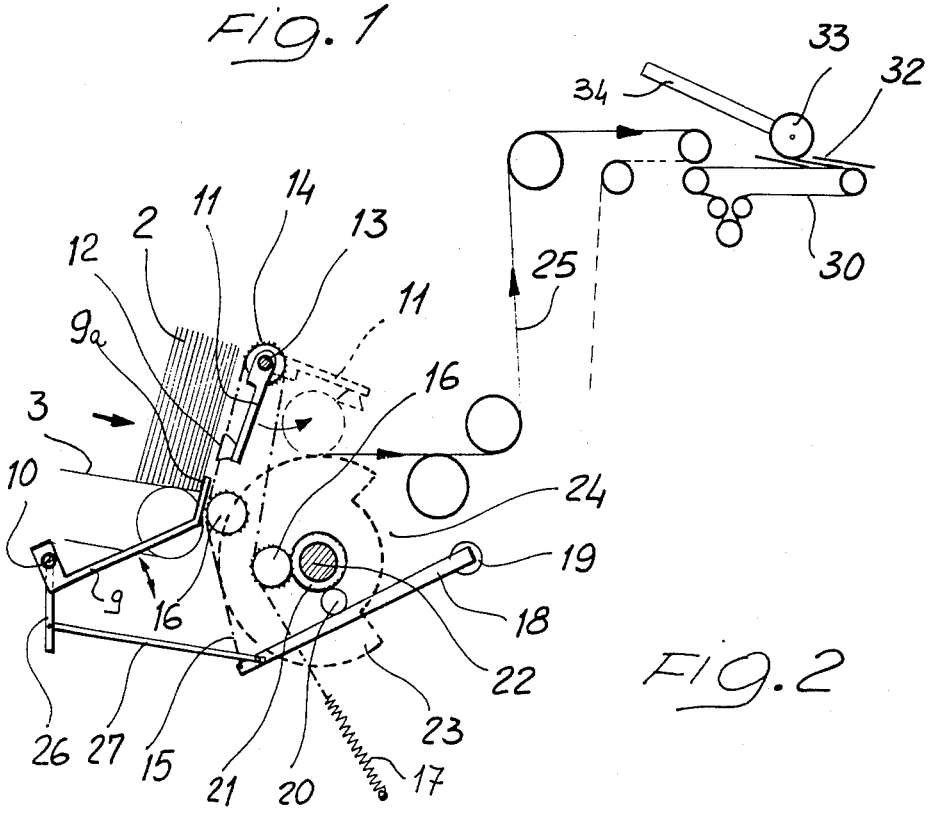
FIG. 2 is a schematic side view of a part of the machine of FIG. 1, comprising a device for separating individual signatures from a stack of these, and a line for conveying these latter to the output.

Immediately above the abutment **9*a* there are mounted a series of small arms 11 carrying respective suckers 12. As can be seen in FIG. 2 the arms 11 are mounted on a transverse spindle 13 on which is keyed a sprocket 14 which engages a chain 15 which passes over two pulleys 16 and one end of which is attached to one end of a tension coil spring 17 fixed at its other end to the frame or side of the machine. At its other end the chain 15 is attached to the free end of a lever 18 pivoted at its other end 19 to a fixed part of the machine. In an intermediate position along its length the lever 18 carries a roller 20 which can engage a cam 21 keyed to a shaft 22. On this shaft 22 are mounted a plurality of wheels 23 having a perimetral discontinuity or notch 24 into which the lower edge of an individual signature can extend when, in operation of the machine, it has been taken from the stack by the said small sucker arms 11** as will be described in more detail below.

Adjacent the signature separator is a signature elevator comprising a plurality of adjacent conveyor belts 25 extending upwardly from the signature separator to an upper horizontal conveyor 30. As can be seen in FIG. 2, at the pivoted end of the arm 9 carrying the said abutment **9*a* there is fixed a projection 26 to which is articulated one end of a rod 27 the opposite end of which is pivoted to the said cam-operated lever 18. In operation of the machine, the shaft 22 is driven to rotate and at each revolution the cam 21 acts by means of the rollers 20 on the lever 18 pressing it downwardly from the position shown in FIG. 2. This causes a tension on the chain 15** which, moving against the tension of the spring 17 causes a corresponding rotation of the sucker arms 11 to the position shown in broken outline in FIG. 2.

During rotation of these arms, which is preferably in the region of 120°, the abutment 9*a* is raised by the movement of the link rod 27 and the projection 26, turning the arm 9 in an anti-clockwise direction as viewed in FIG. 2 presses the abutment 9*a* firmly against the remaining signatures of the stack, guaranteeing the removal of only the first signature.

On the other hand, when the lobe of the cam 21 has passed the position where it displaces the lever 18 downwardly and, therefore, when the arms 11 are in the position shown in solid outline in FIG. 2 and the suckers 12 are in contact with the first signature of the stack 2, the abutment 9 is located at its lowest position such as to allow the withdrawal of the first signature from the stack when the suckers 12 start to move upon rotation of the arms 11.

Close to the said signature separator mechanism on the in-feed table, there is provided a roller (not shown) mounted at the end of a lever shaped in such a way as to be movable between a position obscuring at least one photoelectric cell from a light source and a position where it does not obscure the photoelectric cell, in dependence on the thrust exerted on the roller itself by the stack of signatures on the in-feed table. As the signatures accumulate on the in-feed table 1 they gradually exert an increasing pressure until when there are a sufficiently high number of signatures present on the in-feed table the said lever, by interposing itself between the light source and the photocell, causes the signature advance device to stop until the thrust exerted by these latter on the said roller falls below a convenient predetermined value.

After having been separated from the stack by the signature separator the individual signatures, gripped between pairs of facing belts 25, are thereafter translated upwardly by the action of these belts themselves. These conveyor belts 25 follow a complex path and are provided with an appropriate tensioner device constituted by a series of jockey or idler pulleys supported by arms pivoted about a transverse shaft 28 on which act tension springs 29. These tension springs 29 act to tension the belts 25 so as to exert an appropriate pressure on the individual signatures at the pick-up wheels 23.

Figure 1:
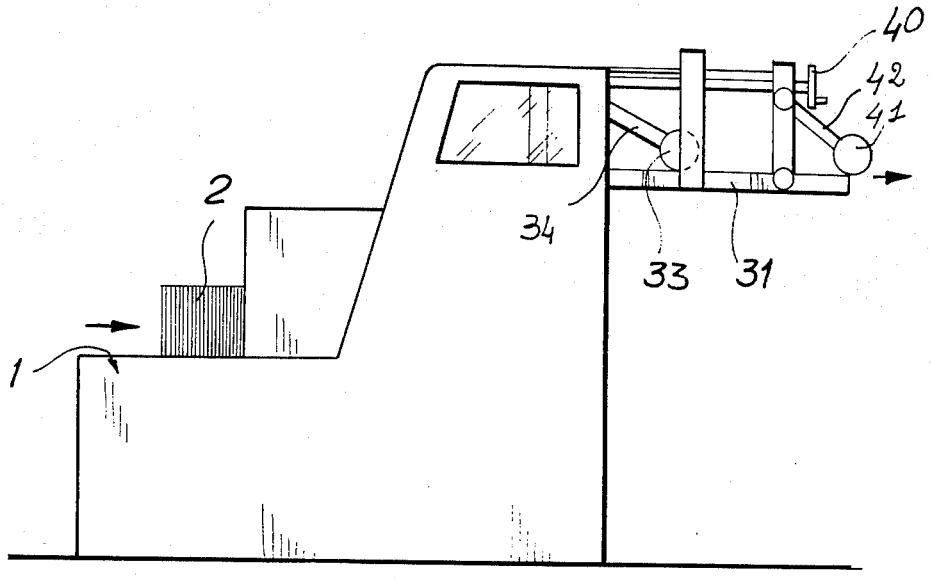
FIG. 1 is a schematic side view of the machine constituting the embodiment of the invention.

The elevator conveyor belts 25 raise the signatures to the level of a horizontal conveyor 30 constituting an upper table, generally indicated 31 in FIG. 1, on which the signatures are disposed in a partially overlapping position assuming the form of scales or shingles indicated by the reference numeral 32 in FIG. 2. This effect is achieved by virtue of the fact that the said horizontal conveyor belts 30 run at a slower speed than the belts 25, and is aided by the action of pairs of wheels 33 acting in contact with the belts 30 themselves. This pair of wheels 33 is mounted on an axle carried for rotation at the end of an arm 34 articulated to a vertical bar 35 engaged on a horizontal screw threaded round bar 36 suspended by a frame structure 37 and provided at its free end with a toothed pinion 38. This frame structure 37 slidably carries a second frame structure 48 which is coupled thereto, also by means of a threaded bar 39 capable of being rotated by means of a handwheel 40 carrying a pinion 45 which meshes with the pinion 38.

The second frame structure carries a second pair of wheels 41 supported by an arm 42 and driven to rotate by a belt 43 which takes drive from a shaft 44 on which the arm 42 is carried.

By turning the said handwheel 40 in one direction or the opposite direction it is possible to obtain a relative displacement of the said pairs of wheels 33 and 41 thereby adapting their position to the various different forms and dimensions of signatures which may be fed on the machine, in such a way as to convey these, at the output, in the desired disposition.

The signature feeder machine is likewise provided, at the in-feed table 1, with two lateral containment walls 46 carrying at least one row of bearings 47 with vertical axes which allow free movement of the stack of signatures on the in-feed table and relieve the pressure exerted by the signatures situated upstream.

What is claimed is:

1. A signature feeder comprising:

an in-feed table for conveying signatures disposed in a stack adjacent one another and each in an almost vertical aspect, a signature separator adjacent said in-feed table and operating to separate said signatures one at a time from said stack and receiving signatures in a stack from said in-feed table a signature elevator operatively connected to said signature separator and operating to raise said signatures to an upper level, a horizontal conveyor at said upper level on which said signatures are disposed in a partly overlapping shingle configuration, said signature separator comprising a plurality of sucker devices, a plurality of pivoted arms carrying said sucker devices, a horizontal spindle, said pivoted arms being turnable about said horizontal spindle, and a plurality of rotatable discs each having circumferential recess or notch means therein for receiving the lower edge of a signature removed from said stack thereof by said sucker devices whereby to transfer said signature to said signature elevator to be conveyed to said upper level and placed on said upper horizontal conveyor, said horizontal conveyor being constituted by a plurality of conveyor belts, means driving said conveyor belts of said upper horizontal conveyor at a slower speed than that of said signature elevator, said upper horizontal conveyor having cooperating rollers which cause said signatures to accumulate on said upper horizontal conveyor in a partly overlapping configuration.

2. The signature feeder of claim 1, wherein said in-feed table is constituted by a plate over which pass a series of toothed belts having a high co-efficient of friction; said belts being carried on respective pairs of pulleys of which those located at the downstream end of said table are mounted on a transverse shaft driven via belts and pulleys, by a geared motor unit.

3. The signature feeder of claim 1, wherein said signature separator includes a stack stop device in the form of an abutment at the end of a pivoted arm which cooperates with the said arms carrying said suckers, the said horizontal spindle carrying said arms being keyed to a sprocket.

4. The signature feeder of claim 3, wherein said sprocket is engaged by a chain guided by pulleys and fixed at one end to a tension spring the other end of which is fixed to a fixed part of the machine itself; means attaching the other end of said chain to one end of a lever, the other end of said lever being pivoted to a fixed point, a cam-follower roller on which acts a cam keyed to a horizontal shaft being carried in an intermediate position on said lever.

5. The signature feeder of claim 4, wherein said shaft carries said discs of said signature separator, said circumferential recesses acting to receive the lower edge of each said individual signature taken from said stack by said sucker arms and transferring said individual signatures to said signature elevator.

6. The signature feeder of claim 3, wherein the pivoted end of said arm carrying said abutment also carries a projection to which is articulated one end of a rod the opposite end of which is pivoted to said cam-operated lever.

7. The signature feeder of claim 1, wherein adjacent said signature separator mechanism there is provided a roller mounted at the end of a lever shaped in such a way as to be movable between a photoelectric cell and a light source in dependence on the pressure exerted on said roller itself by said stack of signatures on said in-feed table.

8. The signature feeder of claim 1, wherein said signature elevator is constituted by conveyor belts which follow a complex path and are provided with a tensioner device constituted by a plurality of roller pulleys supported by arms pivoted about a transverse shaft, a plurality of springs acting on said shaft to cause a pressure to be exerted on said individual signatures by said notched discs of said signature separator.

9. The signature feeder of claim 8, wherein said upper horizontal conveyor comprises a plurality of conveyor belts driven at a slower speed than said conveyor belts of said signature elevator and cooperating with at least one pair of rollers whereby to cause said signatures to accumulate in a partly overlapping, shingled configuration.

10. The signature feeder of claim 9, wherein one of said pairs of rollers is mounted on a common axis and coupled rotationally at the end of an arm articulated to a vertical bar which is threadedly engaged on a screw threaded bar supported by a frame structure by means of a further threaded bar which is rotatable by means of a handwheel, said second frame structure carrying a second pair of rollers supported by an arm and rotatable by means of a belt which is driven from a shaft on which said arm itself is pivotally mounted.

11. The signature feeder of claim 1, wherein said in-feed table is provided with two lateral containment walls carrying at least one row of vertical axis bearings against which the sides of a said signature stack on said in-feed table press as said stack thereof moves along said in-feed table.

* * * * *